US009272807B2

(12) United States Patent
Stewart-Stand

(10) Patent No.: US 9,272,807 B2
(45) Date of Patent: Mar. 1, 2016

(54) MULTIPURPOSE EATING UTENSIL

(71) Applicant: Theo Stewart-Stand, Brooklyn, NY (US)

(72) Inventor: Theo Stewart-Stand, Brooklyn, NY (US)

(73) Assignee: FOLDITFLAT, Brooklyn, NY (US)

( * ) Notice: Subject to any disclaimer, the term of this patent is extended or adjusted under 35 U.S.C. 154(b) by 208 days.

(21) Appl. No.: 14/140,586

(22) Filed: Dec. 26, 2013

(65) Prior Publication Data

US 2015/0182051 A1 Jul. 2, 2015

(51) Int. Cl.

| | |
|---|---|
| ***A47G 21/02*** | (2006.01) |
| ***B65D 5/20*** | (2006.01) |
| ***B65D 5/22*** | (2006.01) |
| *A47G 21/00* | (2006.01) |

(52) U.S. Cl.

CPC ..... *B65D 5/2047* (2013.01); *A47G 21/02* (2013.01); *B65D 5/20* (2013.01); *B65D 5/22* (2013.01); *A47G 2021/002* (2013.01)

(58) Field of Classification Search

CPC ..... A47G 21/06; B65D 5/2047; B65D 5/22; B65D 5/20

USPC ..... 30/147–150, 142

See application file for complete search history.

(56) References Cited

U.S. PATENT DOCUMENTS

| | | | | | |
|---|---|---|---|---|---|
| 636,735 | A * | 11/1899 | Davenport | A47F 13/08 | 294/180 |
| 972,777 | A * | 10/1910 | Richardson | A47G 21/06 | 30/147 |
| 1,406,492 | A * | 2/1922 | Robinson | A61C 9/0006 | 433/45 |
| 1,521,768 | A * | 1/1925 | Herrmann | A47G 21/04 | 30/328 |
| 1,607,863 | A * | 11/1926 | Betts | A47G 19/06 | 206/229 |
| 1,851,942 | A * | 3/1932 | Christie | A47G 21/04 | 30/328 |
| 2,318,129 | A * | 5/1943 | Torode | A47G 21/06 | 30/147 |
| 2,453,393 | A * | 11/1948 | Wilson | A47G 21/04 | 215/228 |
| 2,456,858 | A * | 12/1948 | Bolling | A47G 21/06 | 24/697.1 |
| 2,473,288 | A * | 6/1949 | McNeill | A47G 21/02 | 30/147 |
| 2,728,516 | A * | 12/1955 | Rodman | A47G 23/0216 | 206/216 |
| 3,121,951 | A * | 2/1964 | Green | A47G 21/02 | 30/149 |
| 3,828,999 | A * | 8/1974 | Humphrey | A47G 21/04 | 229/401 |
| 3,931,925 | A * | 1/1976 | Ruff | A47G 21/04 | 229/125.03 |
| 4,218,010 | A * | 8/1980 | Ruff | A47G 21/04 | 229/125.03 |

(Continued)

OTHER PUBLICATIONS

Yanko Design; Dip and Scoop; Dec. 17, 2013.

*Primary Examiner* — Sean Michalski
(74) *Attorney, Agent, or Firm* — Andrew Wilford

(57) ABSTRACT

A multipurpose eating utensil has a pair of side parts of generally isosceles trapezoidal shape and front and rear end parts, all formed of thin but flexible sheet material. Minor base edges of the side parts are closely juxtaposed and substantially parallel to each other and connected by a hinge. A front utensil part has a pair of straight inner edges juxtaposed closely with the front side edges of the side parts, an outer edge formed with longitudinally projecting fork tines, and a longitudinally extending side edge formed as a cutting tool. A rear utensil part has a pair of straight inner edges juxtaposed closely with the rear side edges of the side parts and an outer edge joining outer ends of the respective inner edges. Front and back hinges connect the inner edges of the front and back parts to the side edges of the side parts.

4 Claims, 2 Drawing Sheets

(56) References Cited

U.S. PATENT DOCUMENTS 4,535,538 A * 8/1985 Nelson ..... A47G 21/02 30/147
4,539,749 A * 9/1985 Hyeong-Woon ..... A47G 21/06 30/147
4,940,189 A * 7/1990 Cremonese ..... B65D 5/008 141/337
5,197,623 A * 3/1993 Wang ..... B65D 51/246 206/542
5,327,650 A * 7/1994 Rojas ..... A47G 21/06 30/147
5,845,403 A * 12/1998 Nivin ..... A47G 21/06 30/147
D434,982 S * 12/2000 Zimmerman ..... B65D 51/246 206/553
D439,163 S * 3/2001 Zimmerman ..... B65D 51/246 D9/433
6,896,515 B2 * 5/2005 Cozzi ..... A61C 9/0006 433/37
D571,162 S * 6/2008 Fite, IV ..... A47G 21/06 D7/642
7,798,327 B1 * 9/2010 Berkani ..... A61F 13/55145 206/440
D646,529 S * 10/2011 Cross ..... A47G 21/06 D7/642
D651,480 S * 1/2012 Cross ..... A47G 21/06 D7/642
8,210,381 B2 * 7/2012 Cross ..... A47G 21/04 215/228
9,131,793 B2 * 9/2015 Cross ..... A47G 19/03
2006/0218795 A1 * 10/2006 Santa Cruz ..... A47G 19/06 30/147
2007/0017964 A1 * 1/2007 Kamolsuwan ..... B65D 5/2047 229/155
2007/0084064 A1 * 4/2007 Fite, IV ..... A47G 19/02 30/324
2007/0101578 A1 * 5/2007 Shirazi ..... A47G 21/06 30/147
2008/0148575 A1 * 6/2008 Chan ..... A47G 21/02 30/150
2010/0218382 A1 * 9/2010 Scott ..... B67B 7/18 30/147
2012/0110746 A1 * 5/2012 Allard Serrano ..... A47G 21/06 7/151
2014/0190022 A1 * 7/2014 Siren ..... A47J 43/281 30/324
2014/0259685 A1 * 9/2014 Cross ..... A47G 21/06 30/150
2015/0175292 A1 * 6/2015 McCullough ..... B65D 5/22 426/128
2015/0257560 A1 * 9/2015 Boateng, II ..... A47G 21/001 30/136
2015/0257561 A1 * 9/2015 Miksovsky ..... A47G 21/06 30/150

* cited by examiner

Fig.3
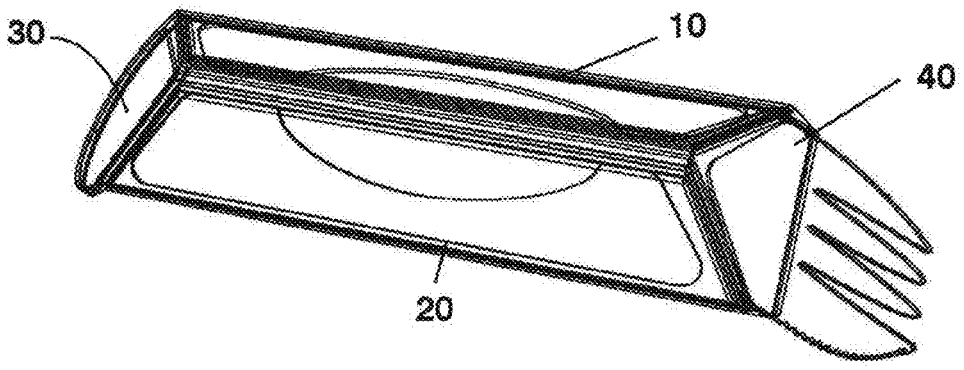
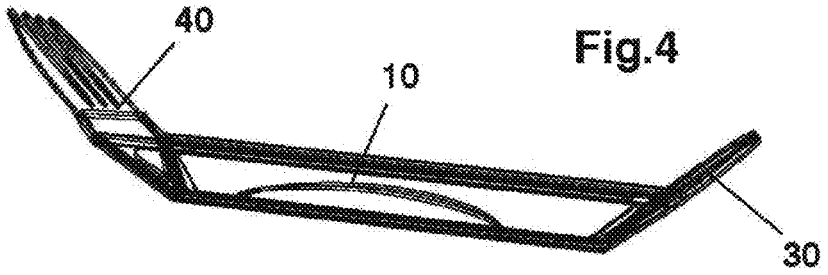
Fig.4
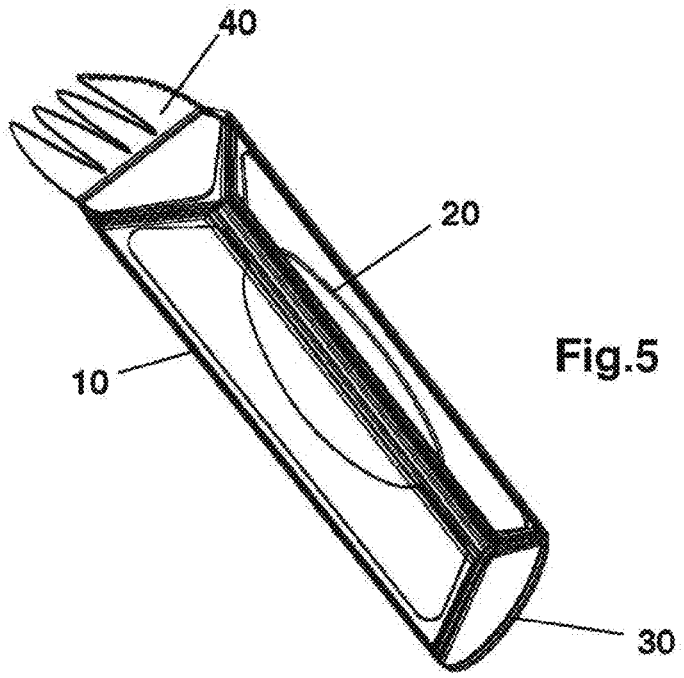
Fig.5

MULTIPURPOSE EATING UTENSIL

FIELD OF THE INVENTION

The present invention relates to a multipurpose eating utensil. More particularly this invention concerns such a utensil that can be used as at least as a spoon or fork, but also as a knife, and that can be carried or stored flat.

BACKGROUND OF THE INVENTION

It is known to make a so-called spork of a single piece of plastic, with one end formed as a standard flat eating-utensil handle, and the other end formed with a slightly cup-shaped bowl for use as a spoon and an outer edge provided with teeth for use as a fork. Such a utensil is typically provided to small children who are not capable of switching between utensils, and who might harm themselves with standard forks, not to mention the harm that could be done even with a plastic knife.

It is also known to provide a pen knife with spoon, fork, and of course knife attachments so that it can be used, for instance, by a camper who need not carry a selection of utensils for eating when away from civilization.

None of these applications is fully satisfactory. The child's spork is useless when food has to be cut or, for instance, it is necessary to spread something like butter. The camper's device requires manipulation for switching from one use to the other. Both systems do not store flat, that is they cannot be reduced to a shape that is efficient for storage and transport.

OBJECTS OF THE INVENTION

It is therefore an object of the present invention to provide an improved multipurpose eating utensil.

Another object is the provision of such an improved multipurpose eating utensil that overcomes the above-given disadvantages, in particular that can be used as both a spoon and a fork and, if desired, a knife also.

A further object is to provide such a utensil that can be used without manipulation for any of its two or three applications.

Another object is to provide such a utensil that can be stored perfectly flat, that is lying in a plane so that it takes is up very little space and can be stacked.

SUMMARY OF THE INVENTION

A multipurpose eating utensil has according to the invention a pair of geometrically similar side parts of generally isosceles trapezoidal shape formed of thin but flexible sheet material and each having a longitudinally extending and short minor base edge, a longitudinally extending and long major base edge generally parallel to the respective minor base edge, and front and rear generally straight side edges diverging from outer ends of the respective minor base edges to outer ends of the respective major base edges. The minor base edges are closely juxtaposed and substantially parallel to each other. The front side edges extend an angle of less than 180° away from each other and the rear side edge similarly extend at an angle of 180° away from each other. A front utensil part formed of thin but flexible sheet material has a pair of straight inner edges juxtaposed closely with the front side edges, an outer edge formed with a pair of longitudinally projecting fork tines, and a longitudinally extending side edge formed as a cutting tool. A rear utensil part formed of thin but flexible sheet material has a pair of straight inner edges juxtaposed closely with the rear side edges and an outer edge joining outer ends of the respective inner edges. An inner hinge interconnects the minor base edges for pivoting of the two side parts relative to each other about an axis substantially parallel to the inner edges between a storage position with the two side parts generally coplanar and a use position with the two parts extending at an angle of less than 180° to each other. Respective front and back hinges connect the inner edges of the front and back parts to the respective side edges of the side parts such that in the storage position all parts are substantially coplanar and in the use position the front and rear parts extend at an acute angle to the Thus this is a very simple structure that can lie completely flat. With the two side parts bent up into the use position, in which their outer edges go from straight to arcuate, the front and rear end parts tip up and the structure becomes fairly stiff. The front end part with the tines forms a fork and its edge forms knife. The rear end part forms a spoon. When the two side parts are not pressed together, the structure goes flat again.

The hinges according to the invention are formed of silicone molded to the parts. They may in be fact be formed by a layer of silicone surrounding the parts. Such a structure can be made at extremely low cost.

In another arrangement that can be made at even lower cost, the parts and hinges are all unitarily formed of plastic. The hinges are thin membranes between the parts.

BRIEF DESCRIPTION OF THE DRAWING

The above and other objects, features, and advantages will become more readily apparent from the following description, reference being made to the accompanying drawing in which:

FIG. 3 is a perspective back view of the utensil when in the use position;

FIG. 4 is a perspective side view of the utensil in the use position; and

FIG. 5 is another perspective back view of the utensil in the use position.

SPECIFIC DESCRIPTION OF THE INVENTION

Figure 1:
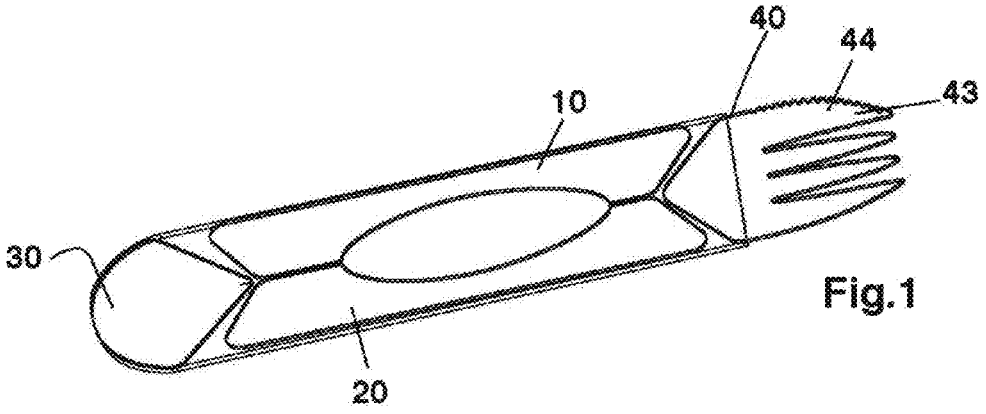
FIG. 1 is a perspective front view of the utensil according to the invention in flattened transport/storage position, it being noted that the perspective back view from the opposite direction is identical.
Figure 2:
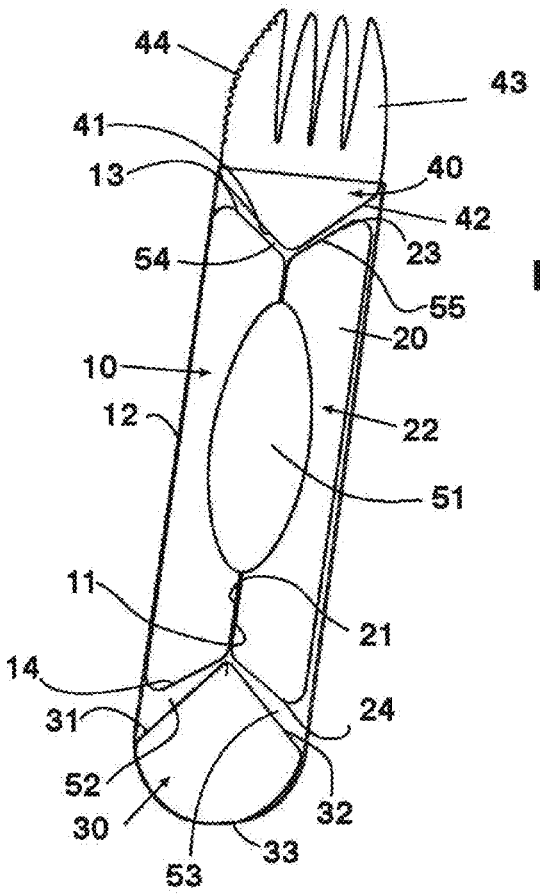
FIG. 2 is a plan view of the flattened utensil.

As seen in FIGS. 1 and 2, the utensil according to the invention shown here in flattened condition is formed basically of two side parts 10 and 20 and two end parts 30 and 40 each stamped out of a flexible but stiff stainless-steel sheet.

The two side parts 10 and 20 are identical isosceles trapezoids with their shorter minor base edges 11 and 21 parallel, longitudinal, and closely juxtaposed, their major base edges 12 and 22 also longitudinal and parallel but turned away from each other, their side edges 13 and 23 extending at 45° to the longitudinal extend and forming a longitudinally open V-shape, and their side edges 14 and 24 similarly extending at 45° to the longitudinal and forming a longitudinally oppositely open V-shape.

The one end part 30 has inner edges 31 and 32 extending at 90° to each other and closely juxtaposed with and parallel to the respective edges 14 and 24 and a circularly arcuate outer edge 33 connecting ends of the edges 31 and 32. This part 30 forms the spoon of the invention as described below.

The other end part 40 has inner edges 41 and 42 extending like the edges 31 and 32 parallel to the respective edges 13 and 23 and an opposite edge formed with four longitudinally projecting triangular tines 43, of which an outer one is formed along its generally longitudinally extending edge with teeth 44. The tines 43 form the fork and the teeth 44 the knife of the invention as described below.

The edges 11 and 21 are connected together by a hinge 51, the edges 14 and 21 by a hinge 52, the edges 24 and 32 by a hinge 53, the edges 13 and 41 by a hinge 54, and the edges 23 and 42 by a hinge 55. This hinge can be made of silicone molded over the parts 10, 20, 30 and 40, could be integral with the parts 10, 20, 30, and 40 if they were all made for instance of plastic, or could be purely mechanical hinges with knuckles and pintles.

The instant invention thus typically lies completely flat, that is with all the parts 10, 20, 30, and 40 coplanar. This makes it easy to carry in a pocket or backpack, and makes it possible to even carry a large number of them in a very small space.

For use all that is necessary as shown in FIGS. 3 and 4 is to press together the outer edges 12 and 22 of the side parts 10 and 20 so that they lie at a large obtuse angle to each other. This causes both the end parts 30 and 40 to pivot upward to a positions with their outer ends raised. In this position the fork tines 43 extend at an angle to the central "handle" formed by the parts 10 and 20, and the raised part 30 forms a concavity usable as the bowl of a spoon centered on a point where the ends 14, 24, 31, and 32 meet. Thus the end of the multipurpose utensil formed by the part 40 is a fork and the end formed by the part 30 is a spoon.

(In this regard it is noted that in reality the outer edges 12 and 22 of the parts 10 and 20 are, contrary to what is shown in FIGS. 3-5, curved in the use position. That is during use both outer edges 12 and 22 would be arcuately concave away from each other.)

The toothed edge 44 can be used as a knife in both the flattened (FIGS. 1 & 2) and use (FIGS. 3-5) positions of the utensil.

I claim:

1. A multipurpose eating utensil comprising:

a pair of geometrically similar side parts of generally isosceles trapezoidal shape formed of thin but flexible sheet material and each having a longitudinally extending and short minor base edge, a longitudinally extending and long major base edge generally parallel to the respective minor base edge, and front and rear generally straight side edges diverging from outer ends of the respective minor base edges to outer ends of the respective major base edges, the minor base edges being closely juxtaposed and substantially parallel to each other, the front side edges extending at an angle of less than 180° away from each other and from the respective minor base edges, the rear side edges similarly extending at an angle of less than 180° away from each other and from the respective minor base edges;

a front utensil part formed of thin but flexible sheet material and having a pair of straight inner edges juxtaposed closely with the front side edges, an outer edge formed with a pair of longitudinally projecting fork tines, and a longitudinally extending side edge formed as a cutting tool;

a rear utensil part formed of thin but flexible sheet material and having a pair of straight inner edges juxtaposed closely with the rear side edges and an outer edge joining outer ends of the respective inner edges; and an inner hinge interconnecting the minor base edges for pivoting of the two side parts relative to each other about an axis substantially parallel to the inner edges between a storage position with the two side parts generally coplanar and a use position with the two side parts extending at an angle of less than 180° to each other; and respective front and back hinges connecting the inner edges of the front and back parts to the respective side edges of the side parts such that in the storage position all parts are substantially coplanar and in the use position the front and rear parts extend at an acute angle to the axis.

2. The eating utensil defined in claim 1, wherein the hinges are formed of silicone molded to the parts.

3. The eating utensil defined in claim 1, further comprising a layer of silicone surrounding the parts and forming the hinges between the parts.

4. The eating utensil defined in claim 1, wherein the parts and hinges are all unitarily formed of plastic, the hinges being thin membranes between the parts.

* * * * *